United States Patent [19]

Wechter

[11] 4,208,941

[45] Jun. 24, 1980

[54] ADJUSTABLE BRIDGE SADDLE

[75] Inventor: Abraham J. Wechter, Kalamazoo, Mich.

[73] Assignee: Norlin Industries, Inc., Lincolnwood, Ill.

[21] Appl. No.: 20,263

[22] Filed: Mar. 14, 1979

[51] Int. Cl.[2] ..... G10D 3/04

[52] U.S. Cl. ..... 84/298; 84/307; 84/314 N

[58] Field of Search ..... 84/298, 299, 307, 314 N

[56] References Cited

U.S. PATENT DOCUMENTS

| | | | |
|---|---|---|---|
| 294,832 | 3/1884 | Wichard | 84/298 |
| 3,174,380 | 3/1965 | Cookerly et al. | 84/314 N |
| 3,971,286 | 7/1976 | Borell | 84/314 N |

FOREIGN PATENT DOCUMENTS

| | | | |
|---|---|---|---|
| 10851 | of 1912 | United Kingdom | 84/299 |
| 1098375 | 1/1968 | United Kingdom | 84/307 |

*Primary Examiner*—Lawrence R. Franklin

*Attorney, Agent, or Firm*—Ronald J. Kransdorf; Jack Kail

[57] ABSTRACT

A guitar or other fretted stringed musical instrument includes intonation adjustment means comprising an aperture underlying a string at the instrument's bridge and a saddle rotatably received within the aperture. The saddle carries a string supporting surface operable in a cam-like manner for adjusting the vibrating length of the string in response to rotation of the saddle within the aperture.

10 Claims, 5 Drawing Figures

FIG. 1
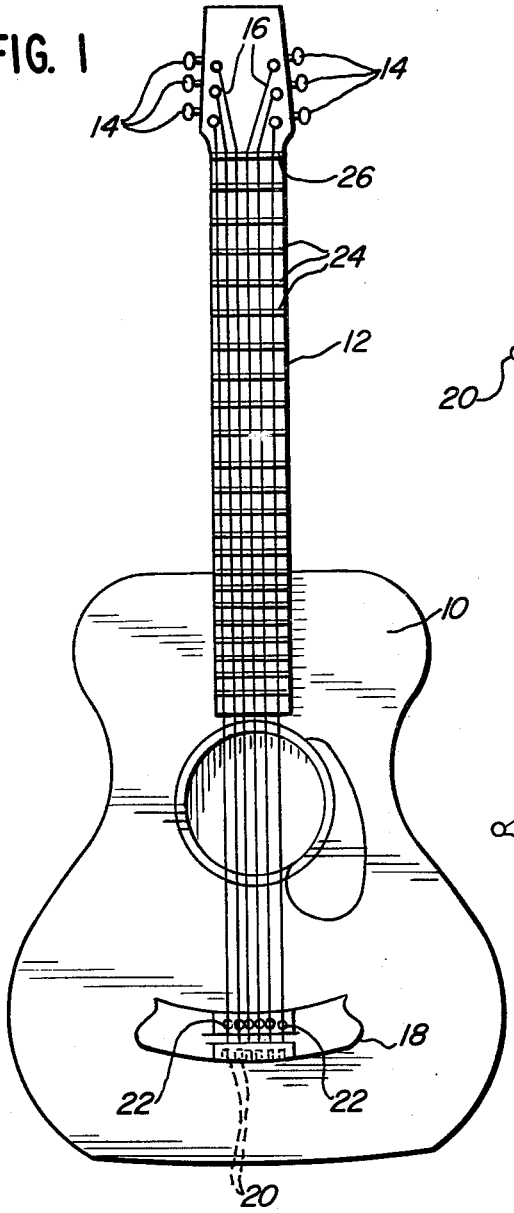
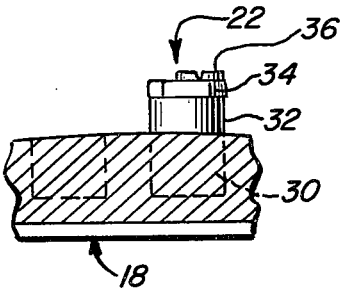
FIG. 3
FIG. 4
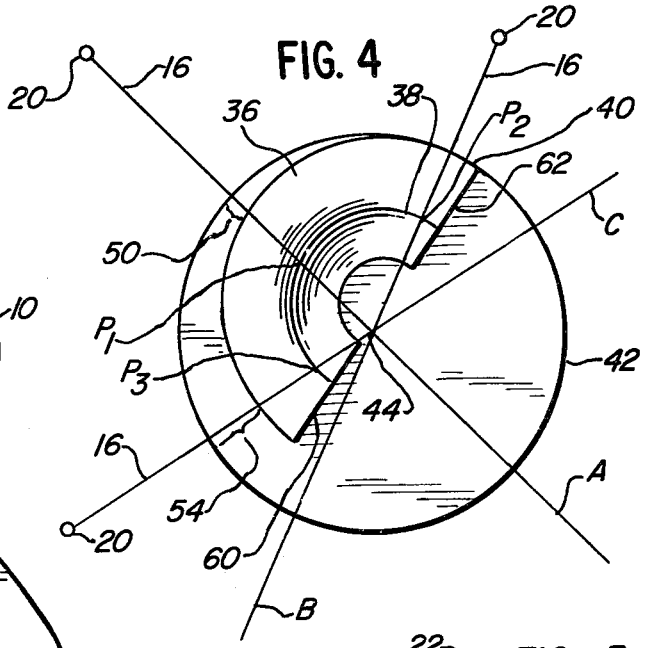
FIG. 5
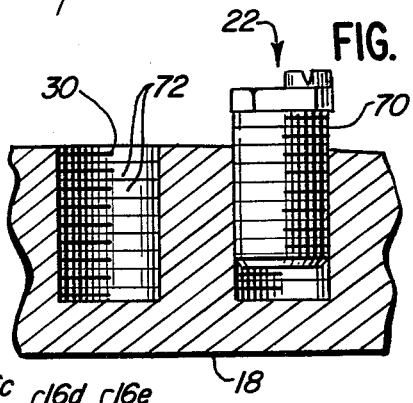
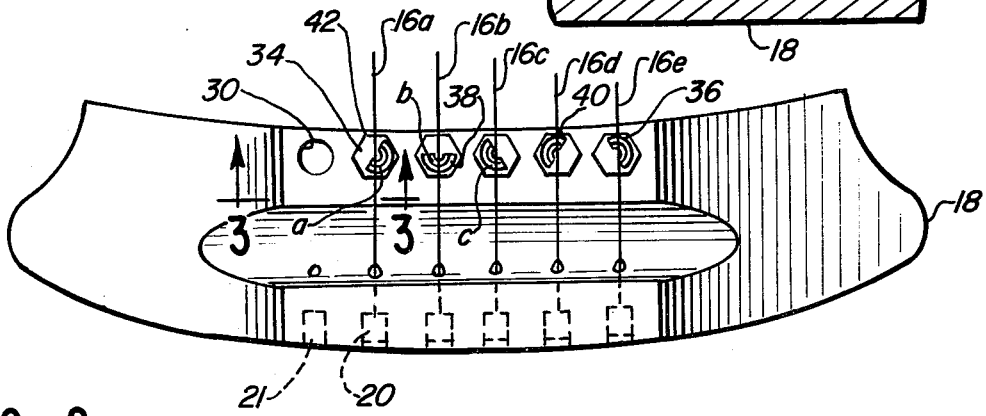
FIG. 2

ADJUSTABLE BRIDGE SADDLE

BACKGROUND OF THE INVENTION

This invention relates generally to a musical instrument, and in particular to an adjustable saddle for use with a stringed musical instrument such as a guitar.

In a stringed musical instrument such as a guitar sound is produced by causing one or more tightly stretched strings to vibrate, the frequency at which the string vibrates, and thus the resultant sound output, being dependent on a number of factors including string length, tension and caliper (thickness). Variations in string caliper, tension and other factors, in particular—the rod-like tendency of the string near its contact points where little or no vibration is produced, make it desirable that the vibrating string length be adjustable to give true intonation wherein the instrument is tuned for producing properly pitched sounds when played. While a number of devices are known for facilitating this adjustment, none have proven altogether satisfactory, especially for acoustic guitars.

Conventionally, one end of each string of a guitar is wound upon a shaft associated with a tuning peg, the other end of the string being anchored to a bridge. The bridge typically includes a saddle having a string supporting surface fixing one end of the effective vibrating length of the strings. The other end of the effective vibrating length of each string is determined by the player when he manually engages or presses the strings against the instrument frets or, when unengaged, by the location of a string nut disposed near the guitar neck. In terms of adjusting the instrument for proper intonation, it is the string length between the saddle and the string nut which is critical and must be fixed for compensating other string variables to produce a properly pitched instrument.

Since the active length of a string may be determined at one end by either the string nut or a fret, when tuning a guitar for proper intonation, the saddle is normally used to effectuate the necessary string length adjustment. Saddles for acoustic guitars conventionally comprise elongate structures transversely disposed underlying the strings and having an upstanding string supporting surface engaging the strings. Such saddles are fixed in position in relation to the guitar sound board and thus afford essentially no intonation adjustment capabilities although sometimes slight adjustments are made by filing off small sections of the saddle. Various saddles have also been developed, particularly for use with solid body electric guitars, which comprise rather complex mechanical structures including longitudinally movable string supporting elements operated by adjustment screws or the like. These structures, however, are relatively complex and expensive and, due to their excessive mass, normally not suitable for use with acoustic guitars.

SUMMARY OF THE INVENTION

It is therefore an object of the present invention to provide a new and improved intonation adjustment mechanism for use with a stringed musical instrument.

More particularly, it is an object of the invention to provide an improved saddle mechanism operable for adjusting the effective vibrating length of a musical instrument string without adversely affecting the sound reproducing characteristics of the instrument.

In accordance with these and other useful objects an adjustable saddle mechanism constructed according to the present invention comprises a generally cylindrically shaped body portion rotatably received within a similarly shaped aperture disposed diametrically underlying a guitar string. An integrally formed coaxial head portion extends from the body portion upwardly beyond the aperture and carries a generally semi-circular shaped string supporting surface engaging the guitar string for defining, in association with the guitar string nut or an engaged fret, the effective vibrating length of the string. The semi-circular string supporting surface is characterized by an axes offset from the axes of the head portion and a diameter smaller than the extent of the head portion. As a result, a "camming" action is produced wherein the effective vibrating string length is adjustable by rotating the saddle and causing the guitar string to be engaged at different points along the string supporting surface.

BRIEF DESCRIPTION OF THE DRAWINGS

An illustrative embodiment of the invention will now be described in conjunction with the accompanying drawings, wherein:

FIG. 1 is a top plan view of a guitar in accordance with the invention;

FIG. 2 is an enlarged top plan view of the bridge of the guitar seen in FIG. 1;

FIG. 3 is a sectional view taken along the lines 3—3 of FIG. 2;

FIG. 4 is a pan view, partly in graphical form, of a saddle showing various exemplary saddle orientations illustrating the principle of the invention; and FIG. 5 is a view similar to FIG. 3 showing a modification of the invention.

DESCRIPTION OF THE PREFERRED EMBODIMENT

The guitar of FIG. 1 includes a body 10 and a neck 12. Rotatably mounted at the distal end of neck 12 are a plurality of conventional tuning pegs 14. Each peg 14 has a shaft associated with it, around which is wrapped one end of one of the guitar strings 16. The other ends of the strings 16 are anchored to a bridge 18 by a plurality of conventional bridge pins 20.

A plurality of saddle members 22 support or engage each of the strings 16 just in front of the bridge pins 20 in order to fix one end of the effective vibrating lengths of the strings. The other end of the effective vibrating length of each string is determined in the conventional manner by the player, when he manually forces the strings against the frets 24, or leaves them open. In the latter instance, the effective vibrating length of the open string is determined by the location of the string nut 26.

The intonation of the guitar strings 16, i.e. their pitch producing characteristics, is dependent on a variety of factors. Strings differ in quality, even those intended to produce the same notes, and portions of the very same string may differ in quality, for instance may be of non-uniform thickness longitudinally thereof. Also, there may be irregularities in the construction of the body of the instrument as well as variations due to aging and the like. These factors may affect the individual strings in different ways. To compensate for these factors, the intonation of the strings 16 is adjustable to a degree by turning tuning pegs 14 which increases or decreases string tension, as is well understood. This method of adjustment is, however, incapable of effecting active string length variations often needed to correct the instrument's intonation. The present invention provides a saddle member operable for individually adjusting the effective vibrating length of each of the strings 16 to a high degree of precision to enable proper intonation to be realized.

In accordance with the preferred embodiment of the invention, bridge 18 (see FIG. 2) includes a plurality of saddle receiving apertures 30, each aperture 30 being disposed just in front of a corresponding bridge pin receiving aperture 21. Strings 16 are anchored between the bridge pins 20 received within apertures 21 and tuning pegs 14 such that they pass centrally or diametrically over saddle receiving apertures 30. While, in the illustrated embodiment, apertures 30 are formed in bridge 18, other methods of forming the apertures are also contemplated as being within the scope of the invention. Thus, for example, apertures 30 may be formed directly in the body of a solid-body electric guitar or the like.

Each aperture 30 (see FIG. 3) is configured for snugly but rotatably receiving the cylindrically shaped body portion 32 of an individual one of the saddle members 22. Saddle members 22 each further includes a head portion 34 extending coaxially from one end of body portion 32 beyond aperture 30, head portion 34 being secured to body portion 32 such that the two portions are rotatable together. It will be observed that due to the coaxial relationship between aperture 30, body portion 32 and head portion 34, the strings 16 will diametrically pass over head portions 34 of saddles 22 as well as apertures 30 when tensioned between bridge pins 20 and tuning pegs 14. This condition is shown in FIG. 2 wherein each of the illustrated strings 16 is anchored by a bridge pin 20 received within an aperture 21 so that it diametrically passes over a head portion 34 of an associated saddle member 22 dividing it into two equal sections.

Each of the head portions 34 of saddles 22 carries an annular raised section 36 defining a generally semi-circular shaped string supporting surface 38. String supporting surface 38 surmounts raised section 36 such that a string 16 passing thereover will only contact one point of the string supporting surface 38 of a particular saddle member 22. In addition, it will be noted that the axes of string supporting surface 38, as well as the axes of raised section 36, is offset with respect to the axes of head portion 34 and that the extent or diameter of raised section 36 is smaller than the diameter of head portion 34. This allows raised section 36 to be seated on head portion 34 with only a small section 40 of its outer periphery being in common with the peripheral edge 42 of head portion 34. As will be explained in further detail, this "off-center cam" configuration of saddle member 22 conveniently allows for infinite adjustment of the effective vibrating length of strings 16 within the dimensional limits of the string supporting surface 38.

The operation of the adjustable saddle members of the invention is most readily understood with reference to FIGS. 2 and 4. Initially, each saddle 22 is inserted in an aperture 30 with a string 16 passing over the center 44 of saddle head portion 34. Each string 16 will therefore engage or rest upon a point along string supporting surface 38 dependent upon the rotational orientation of saddle 22. Thus, in FIG. 2, string **16*a* engages string supporting surface 38 of its associated saddle 22 at point a, string 16*b* at point b, and string 16*c* at point c. The effective vibrating length of each of the strings, which is individually adjustable by rotating its associated saddle member 22 as explained below, is therefore defined by string nut 26 at one end or, alternatively, by an engaged fret 24**, points a, b and c respectively at the other end.

Referring now specifically to FIG. 4, assume initially that saddle member 22 is disposed in orientation A where string 16 passes over the center 44 of head portion 34, engages string supporting surface 38 at point P1 and is anchored to bridge 18 by bridge pin 20. It will be observed that this orientation of saddle 22 most nearly corresponds to that associated with string **16*b* illustrated in FIG. 2. The effective vibrating length of string 16 can now be viewed as consisting of two sections; namely, a first section extending from string nut 26 to the center 44 of head portion 34 and a second section extending from center 44 to point P1 of the string supporting surface 38. Thus, with reference to saddle rotational orientation A, the effective vibrating length of string 16 consists of the length of string between string nut 26 and center 44 of head portion 34 plus the length of string extending radially from center 44 to point P1 of string supporting surface 38**.

The tuning of the instrument by adjusting the effective vibrating string length is accomplished by rotating saddle member 22 within its associated aperture 30. Consider, for example, the effect of rotating saddle 22 in a counterclockwise direction such that the saddle orientation changes from that represented by A toward the orientation represented by B. It will be observed that as saddle 22 is so rotated, the string 16 is shifted along string supporting surface 38 from point P1 toward point P2. Due to the off-center relationship between the string supporting surface 38 and the center 44 of head portion 34, the length of string 16 between center 44 and string supporting surface 38 gradually and continuously increases in response to the counterclockwise rotation of saddle 22. In particular, during the rotation of saddle 22 from orientation A to orientation B, it will be noted that the length of string 16 from center 44 to string supporting surface 38 increases by an amount substantially equivalent to a segment 50 of a radius drawn through center 44. Since the length of string 16 between string nut 26 and center 44 remains constant regardless of the orientation of saddle 22, it will be seen that the overall effective vibrating length of the string increases as saddle 22 is rotated in a counterclockwise direction.

A similar effect is achieved when saddle member 22 is rotated in a clockwise direction except that the change in string length is in a decreasing direction. Thus, consider the effect of rotating saddle 22 in a clockwise direction from orientation A to orientation C. This causes the engagement point of string 16 with the string supporting surface 38 to be shifted from point P1 toward point P3 which, as explained before, continuously decreases the effective vibrating length of the string. In particular, rotation of saddle 22 from orientation A to orientation C will have reduced the overall vibrating length of string 16 by an amount equivalent to the difference in length between string segments 54 and segment 50.

In view of the foregoing, it will be appreciated that the effective vibrating length of each string 16 is infinitely controllable within the dimensional limits of string supporting surface 38 by rotation of the saddle member. Thus, when rotated to an orientation wherein string 16 engages string supporting surface 38 at a point near the end 60 of raised section 36, the effective vibrating length of the string is at a minimum. On the other hand, when string 16 engages string supporting surface 38 at a point near end 62 of raised section 36 the effective vibrating length of the string is maximized. When string 16 engages string supporting surface 38 at any intermediate point, the effective vibrating length of the string is adjusted to a corresponding length between its minimum and maximum lengths.

The saddles illustrated in FIGS. 2 and 4 are shown in orientations such that the strings coming from the tuning pegs 14 initially pass over the center 44 of head portion 34 and then over string supporting surface 38 on their way to bridge pins 20. The saddles may be individually adjusted by 180° of rotation to effect string length changes while maintaining this relationship. Defining the distance from string nut 26 to center 44 as L and the distance between center 44 and the points on string supporting surfacd 38 at ends 60 and 63 of raised section 36 as X and Y, the vibrating string length may therefore be adjusted between the limits defined by the values for L+X and L+Y. A further degree of adjustment may be achieved by orienting the saddles such that the strings coming from the tuning pegs are caused to initially pass over string supporting surface 38 prior to passing over the center 44 of head portion 34. This condition is illustrated in FIG. 2 by strings **16*d* and 16*e*. It will be noted that 180° of rotation of saddle 22** under these circumstances allow for the adjustment of the effective vibrating length of the strings between the limits defined by the values for L−X and L−Y.

Although the extent or degree of vibrating string length adjustment described above may be sufficient in certain cases, it may also be desirable to extend the range of adjustment by providing other saddles having interchangeable body portions but with differently configured string supporting surfaces. Thus, saddles could be provided having cylindrical body portions receivable within apertures 30 and carrying elongate string supporting surfaces disposed across the saddle head portion. Depending upon the position of the straight string supporting surfaces, the effective vibrating length of string 16 would be adjustable to nearly the entire diameter of the saddle head. Also, if desired, the saddle receiving apertures 30 could be angled relative to bridge 18.

Referring to FIG. 5, the saddles 22 and apertures 30 can be formed having cooperating external and internal threads 70 and 72 respectively. Each saddle 22 may thereby be conveniently raised and lowered within its aperture 30 for adjusting the height or action of the associated string 16 by suitably rotating the saddle. By rotating the saddles in multiples of 360°, the height adjustment may be effected without disturbing the previously established string length adjustments.

The entire saddle 22 can be constructed of plastic, aluminum, brass or other suitable hard material. In addition, head 34 may be of a hexagonal shape to facilitate rotation or adjustment by a wrench or other suitable tool under strained pressure.

While particular embodiments of the present invention have been shown and described, it will be apparent that changes and modifications may be made therein without departing from the invention in its broader aspects. The aim of the appended claims, therefore, is to cover all such changes and modifications as fall within the true spirit and scope of the invention.

What is claimed is:

1. In a stringed musical instrument of the type having tuning peg means for anchoring one end of a string and means for anchoring the opposite end of said string, the improvement comprising:

means defining an aperture having a circular cross-section disposed diametrically underlying said string near said opposite end thereof; and saddle means having a generally cylindrically shaped body portion rotatably received within said aperture, a head portion extending beyond said aperture for rotation about a common axis with said body portion and a generally semi-circular string supporting surface disposed in fixed relation on said head portion, said string supporting surface having a diameter smaller than the extent of said head portion and an axis offset from the axis of said head portion, whereby said string supporting surface is operable for adjusting the vibrating length of said string in response to rotation of said saddle means within said aperture.

2. In a guitar or other fretted stringed musical instrument of the type having a tuning peg for anchoring one end of a string, means for anchoring the opposite end of said string, and frets located at spaced intervals along said string for determining musical pitches; the improvement comprising:

means defining an aperture having a circular cross-section disposed diametrically underlying said string near said opposite end thereof; and saddle means received within said aperture having a string supporting surface operable for adjusting the vibrating length of said string in response to rotation of said saddle means within said aperture.

3. The improvement according to claim 2 wherein said saddle means comprises:

a generally cylindrically shaped body portion rotatably received within said aperture;

a head portion extending beyond said aperture for rotation on a common axis with said body portion; and a generally semi-circular string supporting surface disposed in fixed relation on said head portion, said string supporting surface having a diameter smaller than the extent of said head portion and an axis offset from the axis of said head portion.

4. The improvement according to claim 3 wherein all points along said string supporting surface are spaced inwardly from the periphery of said head portion.

5. The improvement according to claim 3 wherein said head portion is configured for facilitating rotation thereof.

6. The improvement according to claim 5 wherein said head portion comprises a hexagonally shaped structure.

7. The improvement according to claim 2 wherein said means defining an aperture comprises a bridge base secured on the soundboard of said guitar.

8. The improvement according to claim 2 wherein said aperture and saddle means include cooperating threaded portions enabling said saddle means to be raised and lowered within said aperture in response to rotation thereof.

9. In a stringed musical instrument of the type having tuning peg means for anchoring one end of a string and means for anchoring the opposite end of said string, the improvement comprising:

means defining an aperture underlying said string near said opposite end thereof; and saddle means received within said aperture having a string supporting surface operable for adjusting the vibrating length of said string in response to rotation of said saddle means about an axis perpendicular to said string.

10. The improvement according to claim 9 wherein said aperture is of circular cross-section disposed for diametrically underlying said string and wherein said saddle means comprises:

a generally cylindrically shaped body portion rotatably received within said aperture;

a head portion extending beyond said aperture for rotation on a common axis with said body portion; and a generally semi-circular string supporting surface disposed in fixed relation on said head portion, said string supporting surface having a diameter smaller than the extent of said head portion and an axis offset from the axis of said head portion.

* * * * *